US005295276A

United States Patent [19]

Richards et al.

[11] Patent Number: 5,295,276

[45] Date of Patent: Mar. 22, 1994

[54] PATIENT POSITIONING AND ALIGNMENT SYSTEM

[76] Inventors: Constance E. Richards; William D. Richards, both of 167 Holliston St., Medway, Mass. 02053

[21] Appl. No.: 882,270

[22] Filed: May 13, 1992

[51] Int. Cl.[5] ..... A47G 9/00

[52] U.S. Cl. ..... 5/648; 5/651

[58] Field of Search ..... 5/630, 632, 633, 621, 5/624, 643, 648, 662, 651

[56] References Cited

U.S. PATENT DOCUMENTS

| | | | |
|---|---|---|---|
| 885,243 | 4/1908 | Haas | 5/630 |
| 1,045,228 | 11/1912 | Weltmer | 5/632 |
| 2,478,497 | 8/1949 | Morrison | 5/648 |
| 2,593,623 | 4/1952 | Stempel | 5/633 |
| 2,724,133 | 11/1955 | Sorrell | 5/630 |
| 3,284,817 | 11/1966 | Landwirth | 5/650 X |
| 3,639,927 | 2/1972 | Munch | 5/651 |
| 4,502,170 | 3/1985 | Morrow | 5/648 |
| 4,597,386 | 1/1986 | Goldstein | 5/633 |
| 4,941,222 | 7/1990 | Prager | 5/630 |
| 4,989,591 | 2/1991 | Anders, Jr. | 5/630 |

*Primary Examiner*—Peter M. Cuomo
*Assistant Examiner*—Michael Milano
*Attorney, Agent, or Firm*—Pandiscio & Pandiscio

[57] ABSTRACT

A system including a footboard and a chock each adapted for secure, yet easily removable attachment at selected locations to the patient support surface of a mattress on an elevating head type bed is provided. The footboard and the chock both include a wedges of resilient material having a substantially planar base surface and a length dimension substantially equal to the width dimension of the patient support surface. The footboard wedge also defines a foot support surface normal to its base surface. The chock defines an upwardly extending curved surface between the forward and rear edges of its base surface. The footboard and the chock further respectively include support members extending along the length of the wedges. Attachment means for affixing the footboard and the chock respectively to the patient support surface extend around the mattress portion of the bed between the opposite side edges of the base surfaces.

15 Claims, 4 Drawing Sheets

PATIENT POSITIONING AND ALIGNMENT SYSTEM

BACKGROUND OF THE INVENTION

1. Field Of The Invention

The invention relates to accessory devices and systems for use with beds adapted to support patients in a partial sitting (i.e., head elevated from the horizontal) position. More particularly, the invention relates to devices and systems for maintaining the position and alignment of patients confined to elevated head type beds over long periods of time.

2. Summary Of The Prior Art

Patients confined to bed for long periods of time, whether in a hospital, an extended care facility or at home, usually utilize a bed which is articulatable so as to place the patient in a partial sitting (i.e., head elevated above the horizontal) position. Unless contra-indicated medically, the partial sitting position is generally the most comfortable for the patient and the most convenient for the caregiver. Specifically, the partial sitting position facilitates the conduct of activities by the patient such as reading, eating, watching television and conversing with visitors. It also facilitates caregiver access to the patient for both medical and hygenic reasons. Indeed, in many cases, the patient by choice remains in the partial sitting position both during the day and at night. There are problems, however.

Bedridden patients are subject to a condition known as foot drop wherein the foot tends to assume a more or less permanent pointed toe configuration. This condition is the result of a combination of a lack of support for the patient's feet and the substantially constant pressure exerted by the bed linen covering them. It is particularly evident in extremely ill patients who for one reason or another are not only confined to bed, but also are limited to lying on their backs.

Relatedly, there is a tendency for patients confined to head elevated type beds to slide towards the foot of the bed when the head of the bed is elevated in order to place the patient in a partial sitting position. This is a serious problem because once a seriously ill patient has slid out of his preferred position and alignment in the bed, it is frequently impossible for him to reposition himself. Accordingly, it falls to the caregiver to assist, and in some cases totally accomplish, the required repositioning. This process can be painful for the patient, particularly if large incisions are involved, and the source of strain and stress upon the caregiver. The repositioning of a patient typically requires that the patient be lowered to a horizontal position, pulled toward the head of the bed and then again elevated to the partial sitting position. Hence, it will be understood that the process is physically demanding, and requires the attention of the caregiver for an extended period when that time might be better spent attending to the medical needs of other patients.

In an attempt to alleviate the foot drop problem, various types of footboards have been provided. The simplest of these were plywood constructions which were slipped under the mattress at the foot end of the bed. These devices were crude in construction and heavy. Further, these wooden constructions were often unfinished, thereby leading to cuts and/or to the pick up of splinters by those attempting to position them. Other types of footboards also have been proposed. Typically, these are metallic constructions which hook over the bedframe at the foot end of the bed or ride on specialized rails located along the sides of the bed. These devices had a limited range of adjustment provided by the manipulation of screws and/or levers or by sliding them along the associated rails. Pillows between the patient's feet and the footboard, however, were often required to accurately adjust the bed to fit a particular patient. They also were cumbersome and ineffective. Further, all of these prior footboards tend to interfere with the changing of bed linens.

Another problem encountered in the use of prior art footboards has been that they require the provision of extensive amounts of padding between the patient's feet and the footboard itself. The reason for this is that the foot engaging surface of these boards were hard and unyeilding. Further, gravity tends to pull the patient from the partial sitting position downwardly along the patient supporting surface of the mattress. This motion is resisted by the engagement of the patient's feet with the footboard. The result, however, is that the patient effectively stands on the footboard constantly. Obviously, it does not take too long for the patient's legs and feet to become cramped and uncomfortable. In fact, in some cases actual physical injury to the patient may result from the strain inflicted upon his legs and feet in this manner.

Still further, as alluded to above, it is often preferrable to allow a bedridden patient to reposition himself, if possible. The patient knows where his pain is, and he instinctively knows how to manipulate himself in order to minimize the infliction of additional pain. A caregiver moving a patient, no matter how carefully, cannot duplicate this instinctive knowledge. To facilitate patient self-movement and to minimize caregiver physical strain, therefore, it has been frequently possible for orthopedic patients to grasp frameworks attached to their beds and/or strap devices fastened thereto in order to assist them in changing positions. It is also common for the caregiver to provide a length of stockinette-like material tied at one end to the bedframe at the foot end of the bed such that the free end is available for the patient to grasp to assist him in changing his position in, getting into or getting out of the bed. Obviously, beds with orthopedic appliances attached to them are not common. Further, the stockinette alternative is somewhat makeshift, and is not wholly desirable for safety reasons.

SUMMARY OF THE INVENTION

Accordingly, it is an object of this invention to provide a system for the maintenance of proper patient positioning and alignment in an elevated head type bed.

It is also an object of this invention to provide a padded footboard which is securely, yet removably and easily, attachable to a mattress.

Another object of the present invention is to provide means for reducing the tendency of a bedridden patient to slip toward the foot end of a head elevated bed which means is securely, yet removably and easily, attachable to a mattress.

Further, it is an object of this invention to provide a removable footboard which is lightweight, yet strong enough to support the weight of a patient reliably.

Still further, it is an object of the invention to provide a footboard structure which includes means for holding bed linens away from the feet and lower extremities of a bedridden patient.

Yet another object of the invention is to provide a removable footboard which includes means for facilitating foot flexure exercises by a bedridden patient without detriment to the integrity of the attachment of the footboard to the mattress.

Yet another object of the invention is to provide means in association with a removable footboard which are safely usable by a bedridden patient to reposition himself within and/or exit or enter the bed with little or no assistance from a caregiver.

These and other features and advantages of the invention are provided by a system including a footboard and a chock. The footboard and the chock both are adapted for removable attachment to the patient support surface of a mattress, the footboard at a selected location substantially adjacent and parallel to the foot end of the bed, and the chock at a selected location substantially parallel to the ends of the bed which is chosen such that the buttocks of a patient will fit between the chock and the location of the upward slant of the head end of the bed to the horizontal when it is in its elevated head position.

More particularly, the footboard member includes a first wedge of resilient material, a rigid first support means and attachment means. The first wedge has a length substantially equal to the width of the mattress upon which it is mounted. It also has a truncated, substantially right triangular, cross-section such that the first wedge includes (1) a base surface having a forward edge, a rear edge and a pair of opposing side edges, (2) a forward surface substantially normal to the base surface at the forward edge and (3) a rear surface extending at an acute angle to the base surface from the rear edge.

The rigid first support means is attached to the first wedge. The first support means includes first and second substantially planar wall members, each wall member having a length substantially equal to the length of the first wedge. The first and second wall members also are disposed at an acute angle to each other such that the first wall member is located adjacent the base surface of the first wedge and the second wall member is located adjacent the rear surface of the first wedge.

The attachment means are flexible and are secured to the support means so as to extend between the opposing side edges of the base surface of the first wedge around the mattress structure.

The chock includes a second wedge of resilient material, second support means and second attachment means. The second wedge has a length substantially equal to the width of the mattress upon which it is to be mounted. It also has a cross-section defined by a substantially straight portion having a forward end and a rear end and an upwardly curved portion extending between the forward end and the rear end such that the second wedge includes (1) a base surface having a forward edge, a rear edge and a pair of opposing side edges, and (2) an upper surface which extends along an upwardly curving arc between the forward and the rear edges of the base surface of the second wedge.

The second support means is attached to the second wedge. It includes a substantially planar wall member which has a length substantially equal to the length of the second wedge, and is located adjacent the base surface of the second wedge.

The second attachment means is flexible and is secured to the second support means so as to extend between the opposing side edges of the base surface of the second wedge around the mattress.

In the preferred embodiments, the wedges are each removably enclosed within covers formed of suitable fire retardant material. The support means are generally formed of a suitable plastic material, and may, if desired, be contained within the wedge covers in operative association with the wedge surfaces with which they correspond as set forth above. In a particularly preferred case, the first support means also includes a rearwardly extending projection located along the apex of the acute angle connecting the planes containing the first and second wall members. This projection improves the stability of the device, and also provides a pivot point which is driven into the patient support surface by forces applied to the upper portion of the forward surface of the first wedge. This burying/pivoting action resists sliding of the footboard rearwardly along the patient support surface of the mattress, and also provides a capability for foot flexure exercises to the patient.

Further, the attachment means in the preferred embodiments are straps of heavy duty woven nylon or similar material. The straps are releasably attached adjacent to the opposite ends of the bases of the respective wedges by buckles or clips extending from the base support members. The preferred buckles or clips provide an easy snap engagement/disengagement and include cinch bar means for tightening the straps around the bottom surface of the mattress and/or mattress support frame. If desired, patient grasping loops may be provided at the ends of the rearmost footboard attachment strap as a patient self-movement facilitating means.

BRIEF DESCRIPTION OF THE DRAWINGS

These and other features and advantages of the present invention will become apparent to those skilled in the art in view of the following detailed description of the preferred embodiments thereof read in conjunction with the appended drawings in which.

DETAILED DESCRIPTION OF PREFERRED EMBODIMENTS

Figure 1:
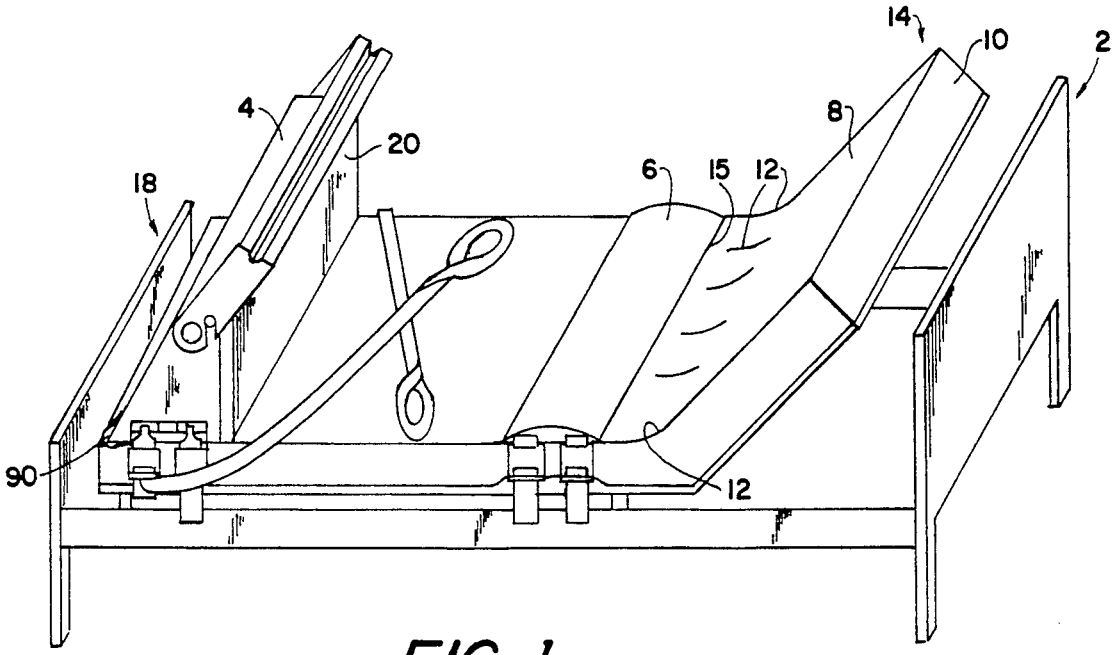
FIG. 1 is a side perspective view of an elevating head type bed to which a footboard and a chock in accordance with the present invention have been attached.

Referring now to the drawings and particularly to FIG. 1, there is shown a side perspective view of an elevating head type bed 2 having a footboard 4 and a chock 6 in accordance with the present invention affixed to the patient support surface 8 of its mattress 10.

The exact position of the footboard 4 and the chock 6 will vary according to the height and size of the patient utilizing the bed. Preferably, the chock 6 will be located relative to the fold 12 in the mattress 10 which arises when the head portion 14 of the bed 2 is raised relative to the horizontal such that the patient's buttocks will fit between the fold 12 and the chock 6. Typically this distance will be approximately eight (8) inches measured rearwardly from the fold 12 to the forward edge 15 of the chock 6. In this position, the chock 6 will fit into the natural cavity located at the junction of the rear of the patient's hip bone and his thigh bones, and thereby will resist the tendency for the patient to slide toward the foot end 18 of the bed when the head portion 14 thereof is in the elevated position.

The footboard 4, on the other hand, will be attached to the patient support surface 8 of the mattress 10 adjacent the foot end 18 of the bed such that when the patient is properly positioned and aligned in the bed 2, the bottoms of his feet will rest against the forward surface 20 of the footboard 4. Stated slightly differently, the usable length of the bed may be varied by the footboard 4 according to the distance between a particular patient's buttocks and the base of his feet when he is in a sitting position.

In the preferred embodiment of the footboard 4 (best seen in FIGS. 2 and 3), a wedge 22 of fire retardant foam or similar resilient material is provided. Alternatively, wedge 22 could also be formed as an inflatable structure. The wedge 22 has a length substantially the same as the width of the mattress 10, and a truncated, substantially right triangular cross section. Thus, the wedge 22 defines a base surface 24, a forward surface 20 extending normally from the front edge 26 of the base surface 24 and a rear surface 28 extending at an acute angle to the rear edge 30 of base surface 24. Wedge 22 is permissably tightly covered by a removable cover member 32 made of vinyl or similar material. A zipper (not shown) extending across the bottom of the cover facilitates its removal from the wedge 22.

Figure 3:
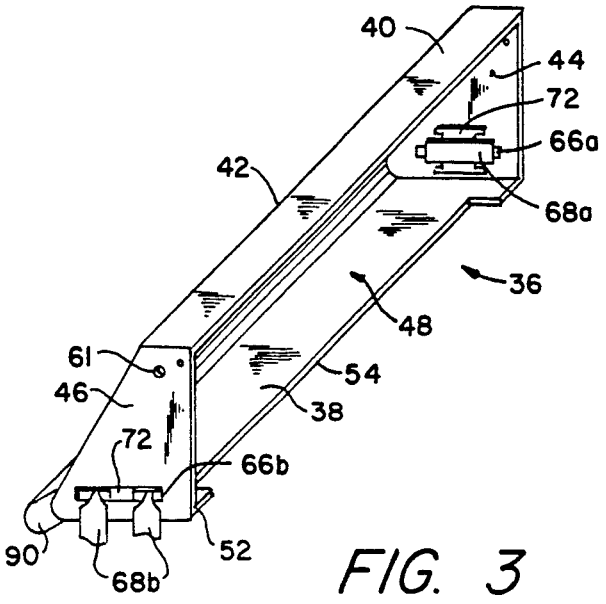
FIG. 3 is a perspective view of the support portion of the footboard of FIG. 2.

The wedge 22 is supported within an outer shell member 36 (best seen in FIG. 3). Outer shell member 36 may be formed of plastic material in any well known manner such as injection molding. It includes a bottom wall 38, a top wall 40, a rear wall 42 and a pair of end walls 44 and 46 which together define an open cavity 48. Open cavity 48 has a substantially truncated right triangular cross section which substantially corresponds to the cross section of the wedge 22, but has a slightly shorter base side. It therefore will be understood that wedge 22 may be removably contained within open cavity 48 such that forward surface 20 and an adjacent section 50 of the wedge 22 extend outwardly of the open end 52 of the open cavity 48. The bottom wall 38 also contains a centered cut out portion 54 adjacent the open end 52 of the cavity 48. As will become more apparent below, cut out portion 54 assures that the feet of a patient in the bed 2 do not pressingly engage a non-resilent member.

A generally U-shaped member 56 may be pivotally attached at its open ends 58 and 60 to holes 61 provided in end walls 44 and 46 of shell member 36 adjacent top wall 40 thereof. Member 56 serves as a convenient carrying/moving handle, and may either be folded against the rear wall 42 or left in its upright handle position during use depending upon the extent of the medical need for the formation of a tent out of the bed linen covering the patient in the area of his feet and lower extremities. Extensions (not shown) may be added to member 56 to enlarge the height and size of the bed linen tent, for example by bolting the same to sides 62 and 64 of the U-shaped member, if desired.

A slot 66*a*, 66*b* is provided in each of the end walls 44, 46 adjacent and parallel to the base wall 38. A length 68*a*, 68*b* of strap material having a portion 70, 71 of a buckle attached to each of its ends extends through each of the slots 66*a*, 66*b* such that the buckle portions are located adjacent the outer sides of the end walls 44 and 46, and the lengths 68 of strap material form a loop within the open cavity 48 adjacent the inner sides of the end walls 44 and 46. Retaining plates representatively shown at 72, having a generally H-shape are located within the loops such that the exertion of force upon the ends of the lengths 68*a*, 68*b* draw the loops against the plates, and the plates resist the passage of the loops through the slots.

Lengths 76 and 78 of strap material carrying mating buckle portions 80 and 82 to buckle portions 70 and 71 extend between corresponding ends of lengths 68*a* and 68*b* such that when lengths 76 and 78 extend under the mattress and/or the mattress frame of the bed and are joined to their corresponding buckle portions, the footboard may be securely attached to the bed. The details of this attachment will be discussed in more detail below. Suffice it to say at this point that the buckles are contemplated to be of a quick release type and to include a cinch bar for the attachment of the strap lengths 76 and 78 thereto.

Figure 4:
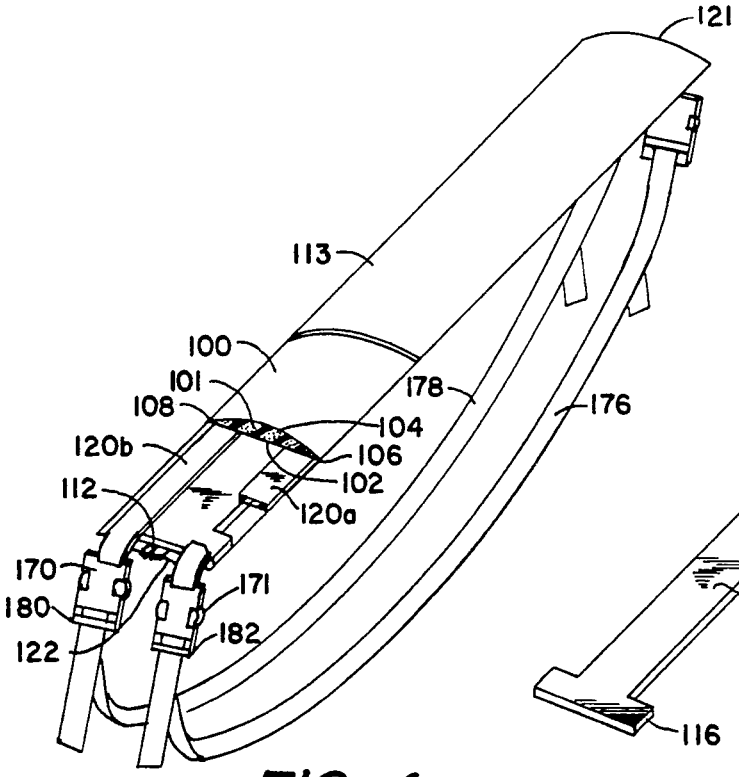
FIG. 4 is a perspective view in partial section of a chock assembly in accordance with the present invention.

The chock device is best seen in the partial cut away perspective view of FIG. 4. It includes a wedge 100 of foam or other resilient material which has a length substantially the same as the width of the mattress 10. Alternatively, wedge 100 could also be formed as an inflatable structure. The transverse cross section 101 of the wedge 100 includes a substantially straight base line 102 and an upwardly curving arc 104 connecting the opposite ends 106, 108 of the base line.

Figure 5:
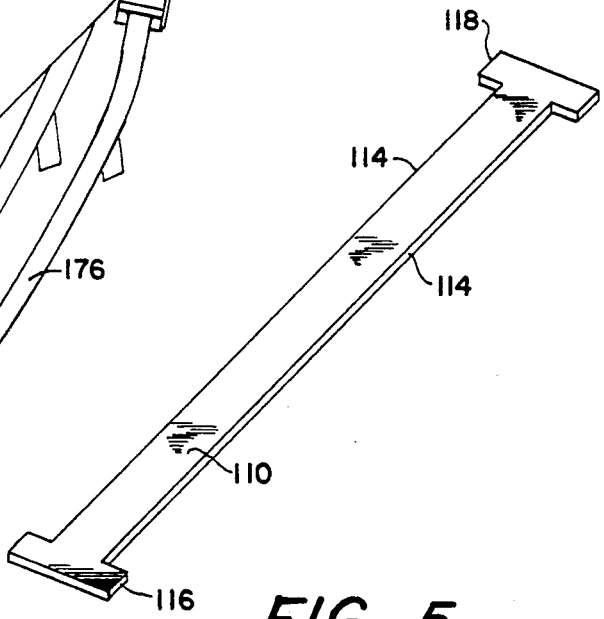
FIG. 5 is a perspective view of the support portion of the chock assembly in accordance with the present invention.

A substantially planar support member 110 (best seen in FIG. 5) is attached to the base surface corresponding to the base line 102 of the wedge 100. In the preferred embodiment shown, this is accomplished by the removable enclosure of the wedge 100 and the support member 110 within a tight fitting cover 113 of vinyl or similar material. Zipper 112 extending along the length of the base surface of the wedge 100 facilitates this assembly. It should be noted that as was the case with the base wall of the supporting shell for the footboard wedge 22, the support member 110 contains central cut out portions 114 along its forward and rear edages 116 and 118. The purpose of these cut out regions is to ensure that the patient is not pressingly engaging a ridgid member in utilizing the present system.

The means for attaching the chock to the mattress is essentially the same as the means previously described with regard to the attachment of the footboard to the bed. That description will not be repeated here. It should be noted, however, that instead of loops engaging slots, the lengths of strap material 120*a* and 120*b* extend along the base surface of the wedge 100 between the wedge and the support member 110. The lengths of strap material 120*a* and 120*b* are stitched to the cover member 113 adjacent their buckle portion carrying ends. This assures that the tightening of the straps around the mattress tends to cinch the chock to the bed without causing it to bow significantly between its opposite outer ends 121 and 122.

Figure 6:
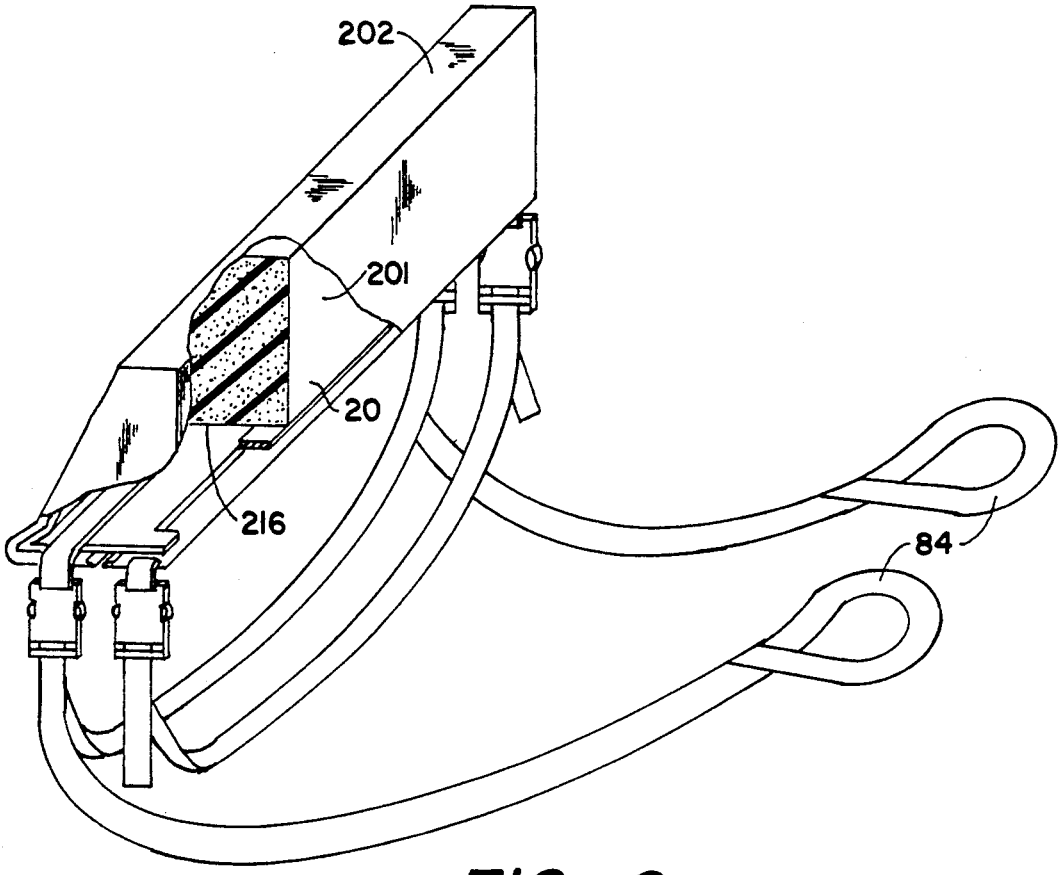
FIG. 6 is a perspective view in partial section of an alternative footboard in accordance with the present invention.
Figure 7:
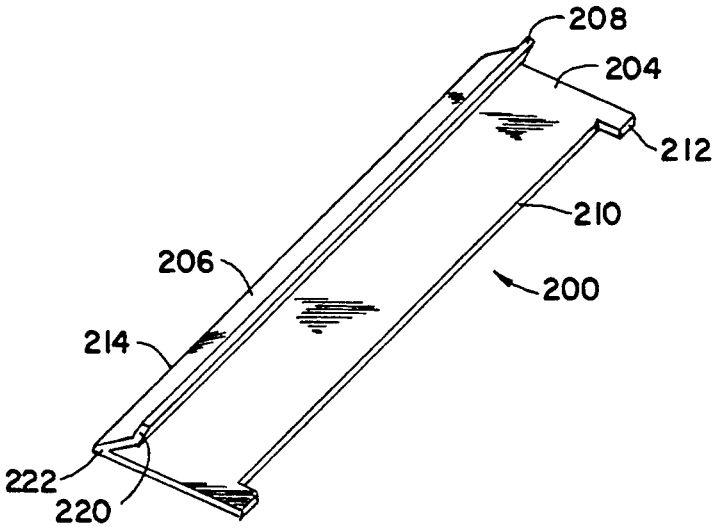
FIG. 7 is a perspective view of the support portion of the footboard of FIG. 6.

The footboard can alternatively be made in a manner similar to that just described for the chock if desired as shown in FIG. 6. In this alternative, the support shell is not used. Instead, a support member 200 substantially as shown in FIG. 7 is located adjacent the wedge 201 and affixed in place by the cover 202. The attachment means is in all relevant particulars the same as that just described for the chock.

The support member 200 includes three substantially planar wall portions 204, 206 and 208. The base wall portion 204 includes a central cut out 210 along its forward edge 212 and extends rearwardly from a point adjacent the forward surface 20 of the wedge to a rear edge 214 which is spaced slightly rearwardly of the rear edge (not shown) of base surface 216 of the wedge 201. Wall portion 206 extends at a small acute angle forwardly from the rear edge 214 of wall portion 204 to an edge 220, and the wall portion 208 extends at an acute angle forwardly and upwardly from wall portion 206. A projection 222 therefore extends rearwardly from the joinder of the planes containing wall portions 204 and 208.

In the preferred mode of use, the chock is located at the desired distance from the articulating fold 12 associated with the raising of the head portion 14 of the bed 2 with the substantially planar supported base surface of the wedge 100 against the patient support surface 8 of the mattress 10 . Two lengths of strap material 176, 178 having buckle portions 180, 182 at their respective outer ends are extended around the bottom and side surfaces of the mattress. The buckle portions 180, 182 are then engaged with the corresponding buckle sections 170, 171 extending outwardly from the side edges of the chock. The free ends of the lengths of strap material extending around the cinch bar portions of the buckle are then pulled tight to anchor the chock to the patient support surface of the mattress 10.

Figure 8:
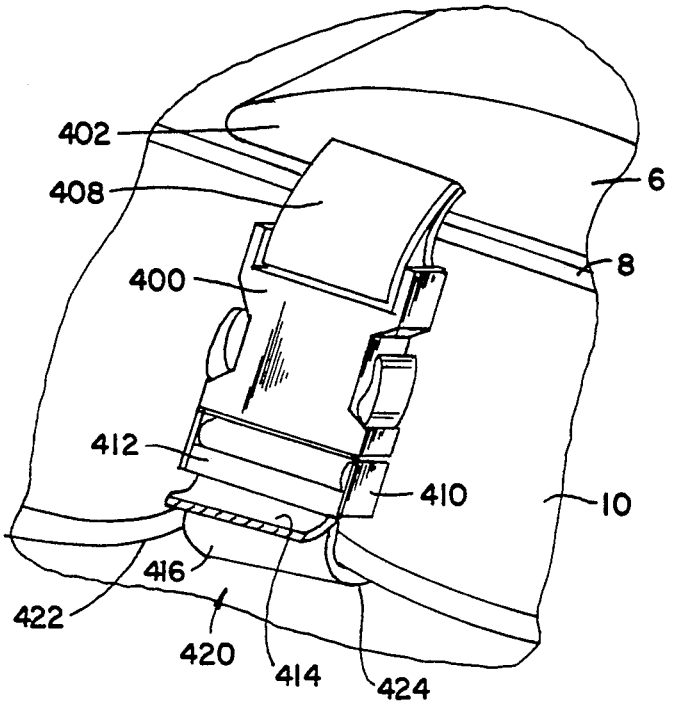
FIG. 8 is a partial side perspective view of a chock in accordance with the invention attached to a mattress.

One such arrangement buckled in attached and tightened relation to mattress 10 is shown in detail in FIG. 8. The female portion 400 of the buckle extends outwardly from a side edge 402 of the chock 6 on strap 408. The male portion 410 of the buckle engages the female portion 400 in an easily releasable snap fit relationship. The male portion also includes a cinch bar 412 around which an end 414 of a length 416 of strap material passes. Once the male portions of the buckles are snap fit into the femal portions at each end of the length 416, the free end 414 is pulled tight around the cinch bar. Because the mattress construction on elevated head type beds is fairly firm and because the female portions of the buckles are effectively anchored adjacent the sides of the mattress by the footboard and chock constructions, the cinching action of the straps with the buckles tends to draw the corners of the lower surface of the mattress around which the straps pass inwardly. This creates an indentation 420 having forward and rearward edges 422, 424. It will be understood that these forward and rearward edges resist movement by the chock along the patient support surface of the mattress.

The footboard attachment is similar to that of the chock at the forward strap locations. The rearward strap, however, extends not only around the mattress, but also the mattress support frame. Thus, the forwad strap reinforces the footboard against movement along the patient support surface, while the rearward strap assures the firm attachment of the footboard to the framework of the bed. The later attachment is of prime importance in those cases wherein the free ends of the strap passing over the cinch bars associated with the rearmost buckles are elongated and include patient grasping loops 84 at their outer ends. The straps are very strong and their secure attachment to the footboard which is itself anchored not only to the bedframe but also against movement along the patient support surface provides a safe means for patient self movement.

Figure 2:
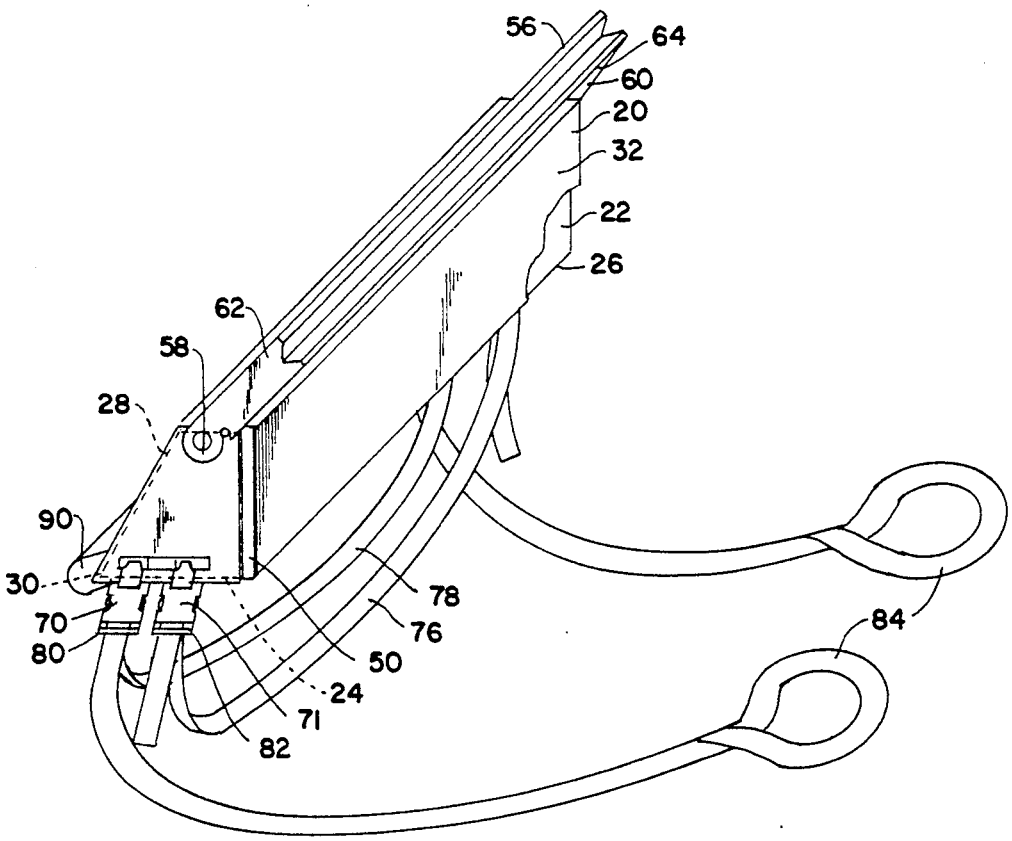
FIG. 2 is a perspective view of a footboard assembly in accordance with the present invention.
Figure 9:
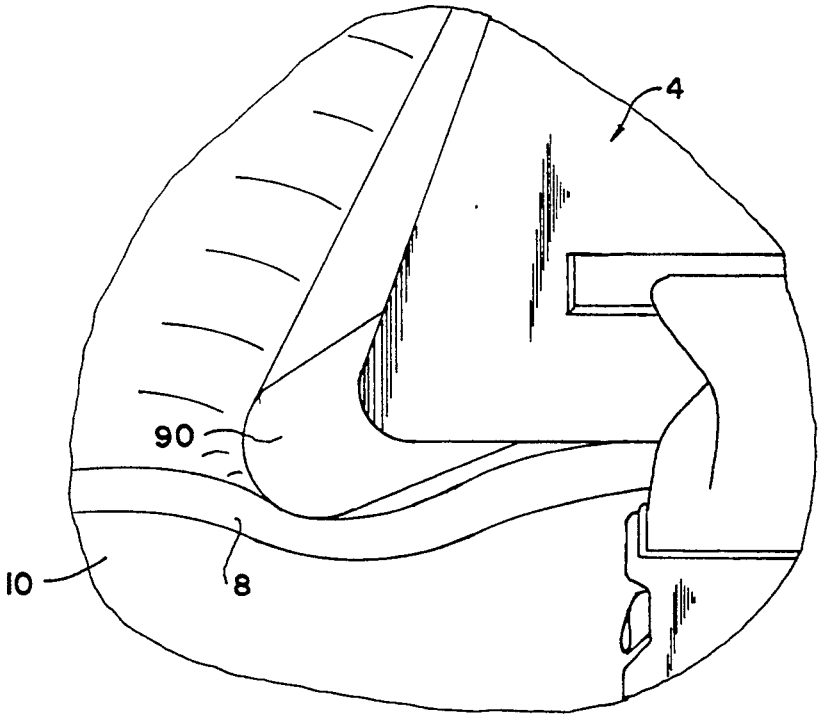
FIG. 9 is a partial side perspective view of the footboard of FIG. 2 attached to a mattress showing the engagement of the projection portion of the support with the mattress surface in detail.

Further, it will be understood that the projection 222 discussed with regard to the support shown in FIG. 7 and the rearward and downward projecting portion 90 of the support embodiment shown in FIGS. 1, 2 and 9 serve the same purposes. Specifically, these projections extend the forward to rear dimension of the base surface with which they are associated and thereby provide greater stability against tipping of the footboard in the forward to rearward direction. Further, given that the front edge of the footboard is secured to the mattress while the rear is secured to the mattress and the mattress frame, it will be understood that forces directed to the top portion of the forward surface 20 of the footboard will tend to pull the mattress upward away from the mattress frame adjacent the forward surface. Since the rear of the footboard is locked to the mattress frame, however, the footboard structure is forced to pivot about the rearward end of the projection. This in turn means that for the footboard to tip rearwardly, the projection must be driven into the firm patient support surface 8 of the mattress 10, a difficult task. Accordingly, the patient may safely exercise his feet by the exertion of force against the upper portion of the resilient forward surface 20 of the footboard. The structure is such that the footboard will "give" in response to this exertion of force, but without danger of the footboard becoming dislodged or sliding along the patient support surface of the mattress away from the patient.

Numerous modifications, variations, changes and alterations of the present invention will occur to those skilled in the art in view of the above detailed description of the preferred embodiments of the invention. Accordingly, it should be understood that the foregoing description is intended to be illustrative of the invention only, and in no way limiting. The invention is limited only by the terms of the appended claims.

We claim:

1. A patient positioning and alignment system for elevating head type beds of the type including a head end, a foot end, an articulating frame member and a mattress having a bottom surface and an upper patient support surface located on said articulating frame, said system comprising:

a footboard member and a chock member;

said footboard member and a said chock member both being adapted for removable attachment to said patient support surface of said mattress, said footboard at a selected location substantially adjacent and parallel to said foot end of said bed, and said chock at a selected located substantially parallel to said ends of said bed chosen such that the buttocks of said patient will fit between said chock and the location of the upward slant of the head end of said bed from the horizontal when said head end is in its elevated position:

said footboard member comprising:

a first wedge of resilient material, said first wedge having a length substantially equal to the width of said mattress and a truncated, substantially right triangular, cross-section such that said first wedge includes (1) a base surface having a forward edge, a rear edge, a pair of opposing side edges, (2) a forward surface substantially normal to said base surface at said forward edge and (3) a rear surface extending at an acute angle to said base surface from said rear edge;

rigid first support means attached to said first wedge, said first support means including first and second substantially planar wall members, each said wall member having a length substantially equal to the length of said first wedge, said first and second wall members being disposed at an acute angle to each other such that said first wall member is located adjacent said rear surface of said first wedge;

flexible attachment means secured to said support means and adapted to extend between said opposing side edges of said base surface of said first wedge around said mattress/frame structure.

2. The system of claim 1 wherein said first wedge is made of foam.

3. The system of claim 1 wherein said first support means comprises a shell having a top surface, a bottom surface, a rear surface and a pair of opposing end surfaces together defining an open cavity adapted to receive and hold said first wedge with said forward surface exposed.

4. The system of claim 3 wherein said open cavity includes an outer edge and said outer edge is spaced from said forward surface of said first wedge.

5. The system of claim 3 further comprising a generally U-shaped member having its free ends respectively pivotally attached to said opposing end surfaces of said shell adjacent said top surface.

6. The system of claim 1 wherein said first support means defines a rearwardly extending projection located along the apex of the acute angle connecting the planes containing said first and said second wall members respectively.

7. The system of claim 6 wherein said projection extends downwardly as well as rearwardly from said walls.

8. The system of claim 1 wherein said wedge is removably enclosed in a tight fitting cover.

9. The system of claim 8 wherein said wedge and said first support means are both removably enclosed in a tight fitting cover.

10. The system of claim 1 wherein said chock member comprises:

a second wedge of resilient material, said second wedge having a length substantially equal to said width of said mattress and a cross section defined by a substantially straight portion having a forward end and a rear end and an upwardly curved portion extending between said forward end and said rear end such that said second wedge includes (1) a base surface having a forward edge, a rear edge and a pair of opposing side edges, and (2) an upper surface which extends along an upwardly curving arc between said forward and said rear edges of said base surface of said second wedge; and second flexible attachment means adapted to extend between said opposing side edges of said base surface of said second wedge around said mattress.

11. The system of claim 10 wherein said second wedge is made of foam.

12. The system of claim 10 wherein said second wedge is enclosed within a single tightly fitting cover.

13. A method for positioning and aligning a patient upon the patient support surface of a mattress located upon a mattress support frame of an elevating head type bed, said method comprising the steps of:

(a) providing a footboard having a planar foot supporting surface and a chock having an upwardly projecting surface, each adapted for removable, fixed attachment to said patient support surface;

said footboard member comprising:

a first wedge of resilient material, said first wedge having a length substantially equal to the width of said mattress and a truncated, substantially right triangular, cross-section such that said first wedge includes (1) a base surface having a forward edge, a rear edge, a pair of opposing sides edges, (2) a forward surface substantially normal to said base surface at said forward edge and (3) a rear surface extending at an acute angle to said base surface from said rear edge;

rigid first support means attached to said first wedge, said first support means including first and second substantially planar wall members, each said wall member having a length substantially equal to the length of said first wedge, said first and second wall members being disposed at an acute angle to each other such that said first wall member is located adjacent said base surface of said first wedge and said second wall member is located adjacent said rear surface of said first wedge;

flexible attachment means secured to said support means and adapted to extend between said opposing side edges of said base surface of said first wedge around said mattress/frame structure;

(b) attaching said footboard across the width of said patient support surface such that said foot support surface is disposed substantially normally to said patient support surface a distance from the elevating head portion of said bed substantially equal to the distance from said patient's buttocks to the base of said patient's feet;

(c) attaching said chock across the width of said patient support surface such that said upwardly projecting surface defines a ridge extending across said patient support surface a distance from said elevating head portion of said bed adapted to closely receive said patient's buttocks; and (d) positioning and aligning said patient upon said patient support surface such that the bottoms of said patient's feed engage said foot support surface, and such that said patient sits upon said patient support surface in the area between said chock and said elevating head portion of said bed.

14. A footboard for removable, fixed location on a patient support surface of a mattress disposed on a frame member comprising:

a first wedge of resilient material, said first wedge having a length substantially equal to the width of said mattress and a truncated, substantially right triangular, cross-section such that said first wedge includes (1) a base surface having a forward edge, a rear edge, a pair of opposing side edges, (2) a forward surface substantially normal to said base surface at said forward edge and (3) a rear surface extending at an acute angle to said base surface from said rear edge;

rigid first support means attached to said first wedge, said first support means including first and second substantially planar wall members, each said wall member having a length substantially equal to the length of said first wedge, said first and second wall members being disposed at an acute angle to each other such that said first wall member is located adjacent said base surface of said first wedge and said second wall member is located adjacent said rear surface of said first wedge;

flexible attachment means secured to said support means and adapted to extend between said opposing side edges of said base surface of said first wedge around said mattress/frame structure.

15. The footboard of claim 14 wherein said first wedge comprises an inflatable sack.

* * * * *